US008124240B2

(12) United States Patent
Ohmi et al.

(10) Patent No.: US 8,124,240 B2
(45) Date of Patent: Feb. 28, 2012

(54) PROTECTIVE FILM STRUCTURE OF METAL MEMBER, METAL COMPONENT EMPLOYING PROTECTIVE FILM STRUCTURE, AND EQUIPMENT FOR PRODUCING SEMICONDUCTOR OR FLAT-PLATE DISPLAY EMPLOYING PROTECTIVE FILM STRUCTURE

(75) Inventors: Tadahiro Ohmi, Miyagi (JP); Yasuyuki Shirai, Miyagi (JP); Hitoshi Morinaga, Miyagi (JP); Yasuhiro Kawase, Miyagi (JP); Masafumi Kitano, Miyagi (JP); Fumikazu Mizutani, Fukuoka (JP); Makoto Ishikawa, Fukuoka (JP); Yukio Kishi, Miyagi (JP)

(73) Assignees: Tohoku University, Sendai-shi (JP); Mitsubishi Chemical Corporation, Tokyo (JP); Nihon Ceratec Co., Ltd., Sendai-shi (JP)

( * ) Notice: Subject to any disclaimer, the term of this patent is extended or adjusted under 35 U.S.C. 154(b) by 1036 days.

(21) Appl. No.: 11/917,633

(22) PCT Filed: Jun. 16, 2006

(86) PCT No.: PCT/JP2006/312110

§ 371 (c)(1),
(2), (4) Date: Dec. 14, 2007

(87) PCT Pub. No.: WO2006/135043

PCT Pub. Date: Dec. 21, 2006

(65) Prior Publication Data

US 2009/0142588 A1 Jun. 4, 2009

(30) Foreign Application Priority Data

Jun. 17, 2005 (JP) ..... 2005-178611

(51) Int. Cl.
*B32B 9/00* (2006.01)

(52) U.S. Cl. ..... 428/469; 428/472; 428/701; 428/702

(58) Field of Classification Search ..... 428/688, 428/701, 702

See application file for complete search history.

(56) References Cited

U.S. PATENT DOCUMENTS 4,125,874 A 11/1978 Higashide et al.

(Continued)

FOREIGN PATENT DOCUMENTS

CN 1511197 A 7/2004

(Continued)

OTHER PUBLICATIONS

Y. Kawase, et al., "An Outgas Free Passivation Technology for Semiconductor Vacuum Chamber Using Advanced Anodic Oxidation", ECS Transactions, vol. 2, No. 9, 2007, pp. 67-71.

(Continued)

*Primary Examiner* — Timothy Speer

(74) *Attorney, Agent, or Firm* — Oblon, Spivak, McClelland, Maier & Neustadt, L.L.P.

(57) ABSTRACT

A protective film structure of a metal member for use in an apparatus for manufacturing a semiconductor or the like, the protective film structure including a first coating layer of faultless aluminum oxide formed by direct anodic oxidation of a base-material metal of an aluminum alloy; and a second coating layer formed on the first coating layer and made of yttrium oxide by a plasma spraying method.

10 Claims, 7 Drawing Sheets

U.S. PATENT DOCUMENTS

| | | | | |
|---|---|---|---|---|
| 5,756,222 | A | 5/1998 | Bercaw et al. | |
| 5,811,195 | A | 9/1998 | Bercaw et al. | |
| 5,919,561 | A | 7/1999 | Fuchs et al. | |
| 5,951,787 | A | 9/1999 | Ohmi et al. | |
| 6,331,754 | B1 | 12/2001 | Satoyoshi et al. | |
| 6,444,304 | B1 * | 9/2002 | Hisamoto et al. | 428/319.1 |
| 6,468,398 | B1 | 10/2002 | Kumamoto et al. | |
| 6,703,135 | B1 * | 3/2004 | Dietz et al. | 428/469 |
| 6,776,873 | B1 | 8/2004 | Sun et al. | |
| 2002/0189776 | A1 | 12/2002 | Kumamoto et al. | |
| 2003/0148623 | A1 | 8/2003 | Ohmi et al. | |
| 2004/0144319 | A1 * | 7/2004 | Nagayama et al. | 118/723 R |
| 2004/0253817 | A1 * | 12/2004 | Imada et al. | 438/688 |
| 2005/0106403 | A1 * | 5/2005 | Yui | 428/469 |

FOREIGN PATENT DOCUMENTS

| | | | |
|---|---|---|---|
| EP | 0 490 914 | B1 | 6/1992 |
| EP | 1 231 299 | A1 | 8/2002 |
| JP | 61-37959 | | 2/1986 |
| JP | 62-103377 | | 5/1987 |
| JP | 01-312088 | | 12/1989 |
| JP | 02-298335 | | 12/1990 |
| JP | 03-072088 | | 3/1991 |
| JP | 05-114582 | | 5/1993 |
| JP | 05-053870 | | 8/1993 |
| JP | 07-233476 | | 9/1995 |
| JP | 08-181048 | | 7/1996 |
| JP | 08-225991 | | 9/1996 |
| JP | 09-069514 | | 3/1997 |
| JP | 09-184094 | | 7/1997 |
| JP | 10-081997 | | 3/1998 |
| JP | 10-130884 | | 5/1998 |
| JP | 11-043734 | | 2/1999 |
| JP | 11-181595 | | 7/1999 |
| JP | 11-302824 | | 11/1999 |
| JP | 2001-104774 | | 4/2001 |
| JP | 2001-135636 | | 5/2001 |
| JP | 2002-177790 | | 6/2002 |
| JP | 2002-180272 | | 6/2002 |
| JP | 2002/299331 | | 10/2002 |
| JP | 2002-356761 | | 12/2002 |
| JP | 2003-166043 | | 6/2003 |
| JP | 2003-179037 | | 6/2003 |
| JP | 2004-060044 | | 2/2004 |
| JP | 2005-105300 | | 4/2005 |
| WO | WO 99/43869 | | 9/1999 |
| WO | WO 03/080892 | A1 | 10/2003 |

OTHER PUBLICATIONS

Yasuhiro Kawase, et al., "A Defect-Free Anodic Oxide Passivation for LSI/FPD Vacuum Chamber", 15th International Symposium on Semiconductor Manufacturing, Conference Proceedings, 2006, pp. 171-174.

Yasuhiro Kawase, et al., "Passivation Technology for Aluminum Surface Using Anodic Oxidation", IEICE Technical Report SDM 2006-193, 2006, pp. 81-86 (with English Abstract).

Yasuhiro Kawase, et al., "Surface Passivation of LSI/FPD Aluminum Alloy Chamber by Anodization", 18th International Micro Electronics Conference Proceedings, 2006, pp. 31-37,(with English Abstract).

European Office Action issued on Jan. 26, 2011 in corresponding European Application No. 06 766 798.0.

European Office Action issued Nov. 15, 2011 in European Application No. 06 766 798.0 (English translation).

* cited by examiner

After $NF_3$ Plasma Irradiation

× 3000

Initial State

Test Condition: 100% $Cl_2$ Gas (3.5 kgf/cm$^2$), 100$^o$C x 24hr

PROTECTIVE FILM STRUCTURE OF METAL MEMBER, METAL COMPONENT EMPLOYING PROTECTIVE FILM STRUCTURE, AND EQUIPMENT FOR PRODUCING SEMICONDUCTOR OR FLAT-PLATE DISPLAY EMPLOYING PROTECTIVE FILM STRUCTURE

TECHNICAL FIELD

This invention relates to a substrate processing apparatus for chemical vapor deposition (CVD), reactive ion etching (RIE), or the like by plasma processing, for use in the semiconductor or flat panel display manufacturing field or the like and, in particular, relates to a processing apparatus suitable for thin film formation or etching that can suppress deposition of reaction products, metal contamination due to corrosion, or the like in a region, such as on the inner wall of a process chamber, brought into contact with a process fluid in the course of the process, and to a protective film structure for use in such a processing apparatus.

BACKGROUND ART

The conventional semiconductor production systems have mainly been the few-kinds mass-production systems represented by the production of memories such as DRAMs. The scale is such that several ten thousands of substrates can be processed per month with a large-scale investment of several hundred billion yen. However, it is strongly desired to establish a staged investment type small-scale semiconductor production system that can make sufficient profits even with those products, such as system LSIs for information home appliances, that are very small in lifetime production amount. The situation is such that since current semiconductor manufacturing apparatuses are monofunctional, an increase in the number of apparatuses and an increase in the investment amount are inevitably brought about and thus small-scale lines cannot be constructed at all. The situation is such that it is difficult to realize small-scale production lines unless a plurality of processes are carried out by a single substrate processing apparatus.

Cases are increasing in which, in order to carry out a uniform CVD process in the plane of a 300 mmϕ or meter-square large-size substrate, a shower head having gas ejection holes is disposed just above the substrate in a process chamber, thereby facilitating uniform diffusion of a gas onto the surface of the substrate. Further, by forming the shower head out of a metal material, it also becomes possible to perform RIE by generating a self-bias on the side of the processing substrate using the shower head itself as a ground surface. By disposing such a metal shower head, it becomes possible to fabricate an apparatus that can perform a plurality of processes in a single process chamber.

When different processes are performed by switching the kind of gas one after another in the same substrate processing chamber, materials forming the inside of the chamber including a gas-supply shower head become one of the important factors. Since the processes such as CVD, RIE, oxidation, and nitriding are performed in the single substrate processing chamber, a cleaning process for resetting the chamber to the initial state per process becomes very important. A fluorine-based gas is mainly used as a cleaning gas in both plasma cleaning and plasmaless cleaning and, in this event, it is preferable in terms of production that the cleaning be carried out while maintaining a process temperature of 250 to 500° C. in the process chamber, the exhaust system, and so on. However, occurrence of corrosion of the forming metal materials cannot be avoided at such a temperature and thus leads to a cause of metal contamination on the surface of a processing substrate. Further, since not only a fluorine-based gas but also a chlorine-based gas are used as etching gases in RIE for processing metal materials, a surface treatment of a metal material such as an Al alloy or stainless of an RIE apparatus is essential. For example, in the case of the Al alloy, an alumite treatment in which anodic oxidation is performed using an acid-based anodization solution to thereby form a porous thick aluminum oxide coating film of several tens of μm has conventionally been a general technique. However, this alumite coating film has a very large effective surface area because of its porous structure and thus there have been problems of the occurrence of contamination during the process due to generation of large quantities of water and organic outgas, and of the prolongation of a downtime such that the degree of vacuum cannot readily increase upon starting a vacuum apparatus after maintenance.

DISCLOSURE OF THE INVENTION

Problem to be Solved by the Invention

It is an object of this invention to provide a surface protective coating film structure excellent in corrosion resistance that can suppress deposition of reaction products on the inner wall or the like, metal contamination due to corrosion of the inner wall or the like, process fluctuation due to outgas, or the like in a substrate processing apparatus using plasma processing for use in the semiconductor or flat panel display manufacturing field or the like.

This invention relates to a substrate processing apparatus using plasma processing for use in the semiconductor or flat panel display manufacturing field or the like and has an object to provide a manufacturing apparatus enabling a plurality of processes, wherein deposition of reaction products on the processing apparatus inner wall or the like, metal contamination due to corrosion of the inner wall or the like, process fluctuation due to outgas, or the like is suppressed.

Means for Solving the Problem

According to this invention, there is obtained a protective film structure of a metal member for use in an apparatus for manufacturing a semiconductor or the like, said protective film structure characterized by comprising a first coating layer having an oxide coating film formed by direct oxidation of a base-material metal and a second coating layer made of a material different from that of the first coating layer.

It is preferable that a surface of the base-material metal is blasted before forming said first coating layer.

The first coating layer is the oxide coating film formed by thermal oxidation of the metal.

The first coating layer may be the oxide coating film formed by anodic oxidation using an electrolyte solution in the form of an organic anodization solution of pH 4 to pH 10. The first coating layer may be the oxide coating film formed by anodic oxidation using an electrolyte solution in the form of an inorganic anodization solution of pH 4 to pH 10.

The first coating layer preferably has a thickness of 10 nm or more and 1 micrometer (μm) or less.

The second coating layer is a coating film formed of one of aluminum oxide, yttrium oxide, magnesium oxide, and a mixed crystal thereof by a plasma spraying method. It is preferred that the second coating layer is about 200 micrometers.

The second coating layer may be a coating film in the form of at least one of a NiP plating, a Ni plating, and a Cr plating.

The second coating layer may be a fluororesin coating film formed by fluororesin coating.

According to this invention, there is obtained a gas supply shower head for a semiconductor or flat panel display manufacturing apparatus, characterized by using the protective film structure of the metal member mentioned above.

Moreover, in accordance with the present invention, there is obtained a metal component for a semiconductor or flat panel display manufacturing apparatus, characterized by using the protective film structure of the metal member mentioned above.

According to this invention, there is obtained a semiconductor or flat panel display manufacturing apparatus characterized by using the protective film structure characterized as described above. Preferably, the protective film structure characterized as described above is used for an inner wall of a process chamber of the semiconductor or flat panel display manufacturing apparatus.

More specifically, on the surface of a metal material used for a gas-supply lower shower plate (also called a shower head) disposed in the process chamber, the inner surface of the process chamber, or the like, there are formed a first coating layer having an oxide coating film with a thickness of 1μ or less formed as an underlayer by direct oxidation of the base material and a second coating layer of about 200 μm made of one of aluminum oxide, yttrium oxide, magnesium oxide, and a mixed crystal thereof. With this configuration, corrosion resistance against irradiation of ions or radicals can be imparted to the second-layer protective film and the effect of a protective layer for preventing corrosion of the surface of the base-material metal caused by diffusion of molecules or ions into the second-layer protective film can be imparted to the first-layer oxide coating film, thereby reducing contamination of a substrate with metals generated from the metal members and the inner surface of the process chamber. It is possible to solve a problem that the second-layer plasma-sprayed protective film is stripped due to corrosion of the interface between the first-layer protective film and the second-layer protective film.

According to this invention, surface protective coating films excellent in corrosion resistance are formed on the inner surface of a process chamber of a semiconductor or flat panel display manufacturing apparatus, thereby suppressing metal contamination of the surface of a substrate from the inside of the substrate processing chamber and it is possible to suppress stoppage of the apparatus/a reduction in operation rate of the apparatus caused by corrosion of an exhaust pump, exhaust system piping, or an exhaust valve.

Further, it is possible to suppress deposition of reaction products, caused by dissociation of a process gas, on the inner wall of the process chamber or the like of the semiconductor or flat panel display manufacturing apparatus and further to suppress deposition of reaction by-products on the inner surface by maintaining the manufacturing apparatus in a heated state at a temperature higher than room temperature.

It becomes possible to realize a multifunction manufacturing apparatus that is capable of carrying out several kinds of processes in a single substrate processing chamber to thereby realize a staged investment type semiconductor or flat panel display production system.

BEST MODE FOR CARRYING OUT THE INVENTION

Hereinbelow, an embodiment of this invention will be described.

Figure 1:
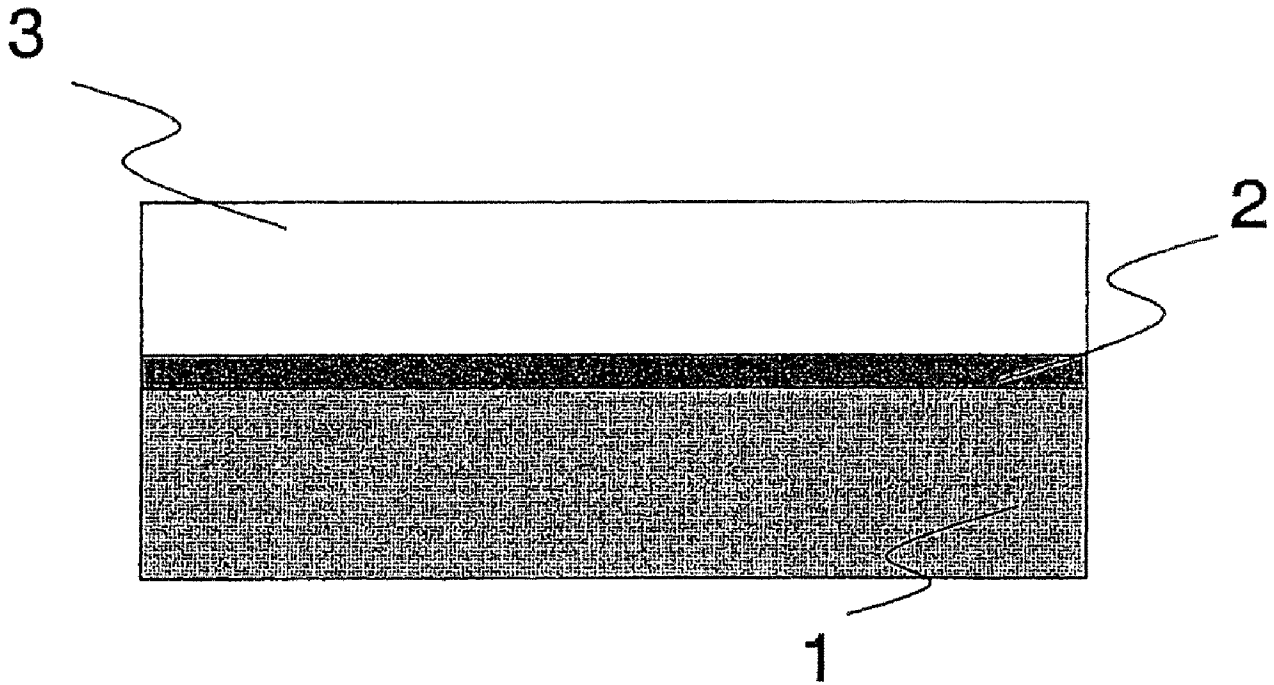
FIG. 1 shows a structural diagram of protective film metal materials of this invention.

FIG. 1 shows a protective film structure of this invention, wherein the structure comprises a first coating layer 2 having an oxide coating film formed on the surface of a base-material metal 1 by direct oxidation of the base material and a second coating layer 3 formed on the first coating layer and made of a material different from that of the first coating layer. Herein, the different materials include a case of different compounds such as aluminum oxide and yttrium oxide or a case of materials of different origins, such as an aluminum oxide film obtained by direct oxidation of aluminum being a base-material metal and an aluminum oxide film obtained by thermal spraying of aluminum oxide powder.

This protective film structure will be described in detail in the case of using a microplasma processing apparatus.

Figure 2:
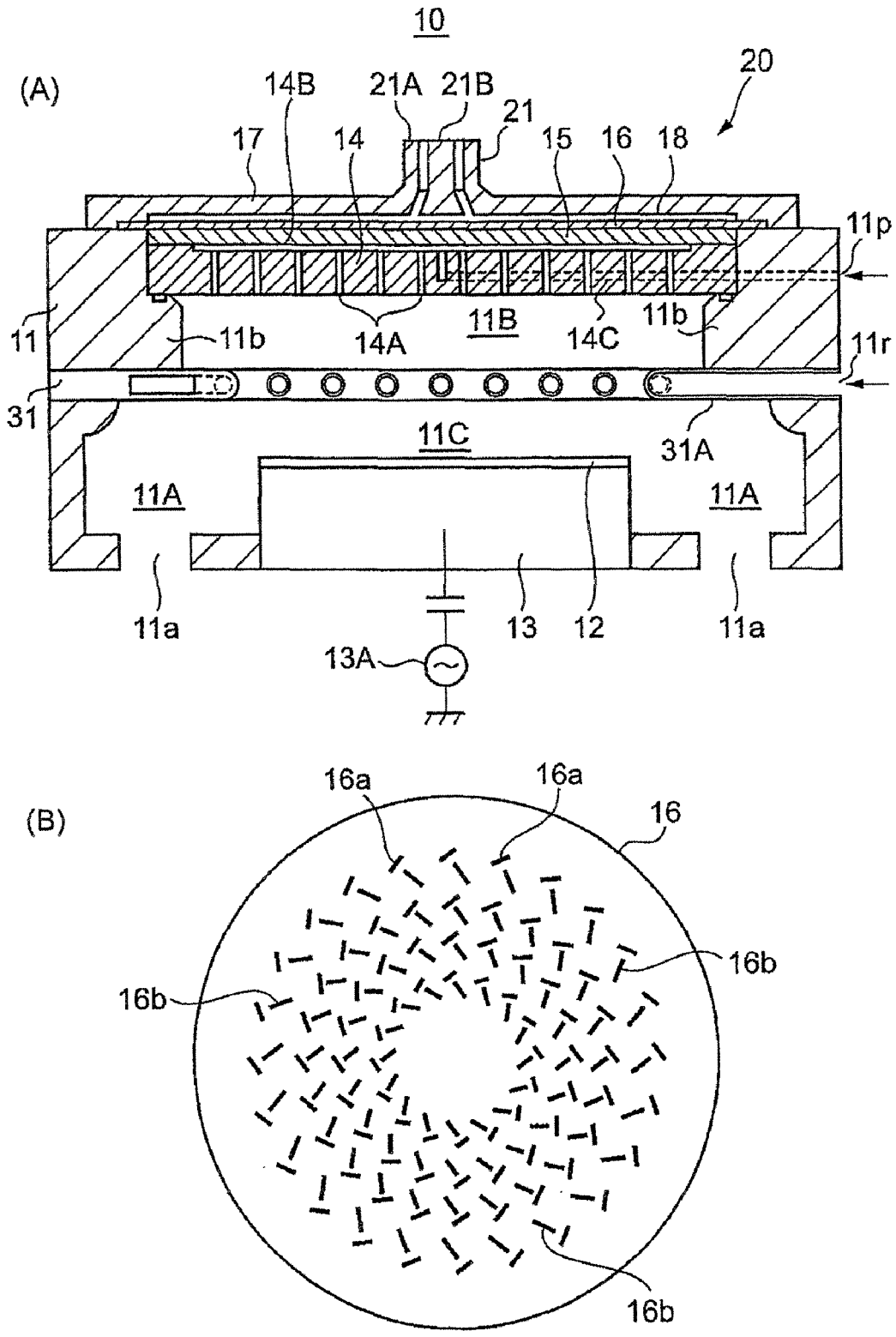
FIG. 2 is an exemplary diagram of a semiconductor manufacturing apparatus using protective film metal materials of this invention.

FIG. 2 shows the structure of a microwave plasma processing apparatus 10 being a semiconductor/flat panel display manufacturing apparatus according to this invention.

In the same figure, a process chamber of the manufacturing apparatus is a microwave-excited plasma process chamber capable of performing a plurality of processes such as CVD, RIE, oxidation, and nitriding. In the process chamber (vacuum container) 11, there are disposed a ceramic upper shower plate 14 having upper gas supply ports in the form of uniformly arranged ejection holes and a lower shower plate (process gas supply structure) 31 of a metal lattice-shaped disk serving as lower gas supply ports. Details of this processing apparatus will be described later.

When the lower process gas supply structure 31 is made of an Al alloy, it is preferable that the material be added with 1 to 4.5% Mg in terms of imparting a mechanical strength as an Al alloy for construction. Further, it is more preferable that the material be further added with 0.1 to 0.5% Zr in terms of concern about degradation of strength at the time of heat application.

In the case of a metal containing aluminum as a main component, it is possible to obtain a metal oxide film by anodic oxidation in a pH 4 to 10 anodization solution. The anodization solution preferably contains at least one kind selected from the group consisting of boric acid, phosphoric acid, organic carboxylic acid, and salts thereof. Further, the anodization solution preferably contains a nonaqueous solvent. It is preferable that a heat treatment be carried out at 100° C. or more after the anodic oxidation. For example, an annealing process can be performed in a heating furnace at 100° C. or more.

Specifically, a first coating layer of the gas-contact surface of the Al alloy lattice-shaped disk 31 is a faultless aluminum oxide coating film with a thickness of 500 nm formed by anodic oxidation using an electrolyte solution in the form of an organic anodization solution controlled at pH 7.

The faultless aluminum oxide coating film is preferably heat-treated in an oxidizing gas atmosphere at a temperature higher than room temperature and is, more preferably, heat-treated in an oxidizing gas atmosphere at 100° C. or more.

In the measurement using an APIMS analyzer, the total water quantity released from the surface after applying the temperatures starting from room temperature and then holding at 300° C. for 2 hours is $1\times10^3$ Pa·m$^3$/sec or less and the mass number of a released organic molecule is 200 or less.

In this invention, an aluminum alloy is preferable as a material of the process chamber, but a stainless steel can also be applied. As the stainless steel, use can be made of an austenitic, ferritic, austenitic-ferritic, or martensitic stainless steel and, for example, austenitic SUS304, SUS304L, SUS310S, SUS316, SUS316L, SUS317, SUS317L, or the like is preferably used. Further, in the case of the stainless steel, the surface is formed into a passive oxide film by heat-treating the stainless steel in an oxidizing atmospheric gas described in Japanese Unexamined Patent Application Publication (JP-A) No. H7-233476 or Japanese Unexamined Patent Application Publication (JP-A) No. H11-302824. For example, the condition of forming aluminum oxide is such that a passive aluminum oxide film is formed by bringing an aluminum-containing stainless steel into contact with an oxidizing gas containing oxygen or water.

The oxygen concentration is 0.5 ppm to 100 ppm, preferably 1 ppm to 50 ppm, while, the water concentration is 0.2 ppm to 50 ppm, preferably 0.5 ppm to 10 ppm. Use may also be made of an oxidizing mixed gas containing hydrogen in the oxidizing gas. The oxidation temperature is 700° C. to 1200° C., preferably 800° C. to 1100° C. The oxidation time is 30 minutes to 3 hours.

A second coating layer of yttrium oxide having a thickness of 200 μm is further formed on the first coating layer by plasma spraying.

In order to achieve sufficient melting of an yttria powder material in plasma spraying for the formation of the yttrium oxide coating film, a plasma spray apparatus is configured such that a material introducing position is provided at a plasma generating portion, thereby sufficiently carrying out the melting of the material. Further, a noble gas added with an oxygen gas is used as a plasma gas to improve the material meltability due to an increase in output, thereby increasing the compactness. Further, the grain sizes of the material yttrium powder are equalized to improve the meltability, thereby reducing voids in the yttria-sprayed film. Moreover, the purity of the yttria powder material is improved so that the impurities in the film are sufficiently reduced. As a result of them, the adhesion strength of the yttria-sprayed film shows a value twice or more that of a conventional plasma-sprayed film. This plasma-sprayed yttria protective film is formed on the upper layer of the first coating of each of the process chamber inner wall or the like in the process chamber (vacuum container) 11 and the Al alloy lattice-shaped disk 31.

In terms of the reaction product deposition amount suppression effect, the effect increases if the in-apparatus surface temperature of this semiconductor/flat panel display manufacturing apparatus system is heated to room temperature or more. Preferably, the effect further increases if the temperature is set to 150° C. to 200° C. In both the first coating layer and the second coating layer, a passive-film surface crack observed in a conventional porous alumite coating film having a thickness of as much as several tens of μm is not observed at a temperature of 300° C. or less. Consequently, there arises no problem of occurrence of corrosion from a crack portion.

When the process is limitative or the like, a second-layer passive film may be a treated surface in the form of at least one of a NiP plating, a Ni plating, and a Cr plating, or a second-layer passive film may be a treated surface in the form of at least one of fluororesin coating films such as PTFE, PFA, FEP, and ETFE coating films.

EXAMPLES

Examples of this invention will be described hereinbelow. Naturally, this invention is not limited to the following examples.

The analysis conditions in the following examples and comparative examples are as follows:

(Analysis Condition 1) Scanning Electron Microscope (hereinafter abbreviated as "SEM Analysis")

Apparatus: JE6700 produced by JEOL (Analysis Condition 2) Fourier Transform Infrared Spectroscopic Analysis (hereinafter abbreviated as "FT-IR Analysis")

Apparatus: Digilab Japan (Analysis Condition 3) Atmospheric Pressure Ionization Mass Spectrometry (hereinafter abbreviated as "APIMS Analysis")

Apparatus: UG-302P produced by Renesas Eastern Japan

In this example, use was made of a JIS A5052 material as aluminum, special grade reagents produced by Wako Pure Chemical Industries, Ltd. as tartaric acid and ethylene glycol, and an EL-grade chemical produced by Mitsubishi Chemical Corporation as aqueous ammonia.

Anodic oxidation was performed using a source meter (2400 series produced by KEITHLEY), wherein a pure platinum plate was used as a cathode and the temperature of an anodization solution was adjusted to 23° C. After the anodic oxidation, an annealing process was performed at a predetermined temperature for 1 hour while flowing a gas with a composition of nitrogen/oxygen=80/20 (vol ratio) at a flow rate of 5 L/min in a quartz tube infrared heating furnace (hereinafter abbreviated as an "IR furnace").

1.8 g of tartaric acid was dissolved into 39.5 g of water, then 158 g of ethylene glycol (EG) was added, and then stirring/mixing was carried out. While stirring this solution, 29% aqueous ammonia was added until the pH of the solution reached 7.1, thereby preparing an anodization solution a. An A5052 aluminum sample piece of 20×8×1 mm was anodized in this anodization solution at a constant current of 1 mA/cm$^2$ at anodization voltages up to 50V and, after 50V was reached, the aluminum sample piece was held at the constant voltage for 30 minutes, thereby carrying out anodic oxidation. After the reaction, it was sufficiently washed with pure water and then dried at room temperature. The obtained aluminum sample piece with an anodized film was annealed at 300° C. for 1 hour in the IR furnace and then opened to the atmosphere so as to be left standing at room temperature for 48 hours.

In order to achieve sufficient melting of an yttria powder material in plasma spraying for formation of an yttrium oxide coating film, a plasma spray apparatus was configured such that a material introducing position was provided at a plasma generating portion, thereby sufficiently carrying out the melting of the material. Further, using an argon gas added with a 10% oxygen gas as a plasma gas, an yttria-sprayed film was formed with an output of 60 kW. The material yttrium powder used was of a 10 μm grain size specification. By this, the meltability is improved to thereby reduce voids in the yttria-sprayed film. Moreover, the purity of the yttria powder material was improved so that the impurity elements in the film were reduced to a level of several ppm. As a result of them, the adhesion strength of the yttria-sprayed film showed a value of 14 MPa which was twice or more that of a conventional plasma-sprayed film. This plasma-sprayed yttria protective film was formed on the upper layer of the first coating being the faultless aluminum oxide protective film formed by the foregoing anodic oxidation.

(Property Evaluation 1—Evaluation of Surface after Plasma Irradiation)

A sample piece fabricated in the manner as described above, i.e. applied with a first coating layer having a faultless aluminum oxide coating film with a thickness of 1μ or less formed as an underlayer by anodic oxidation using an organic anodization solution and a second coating layer formed of yttrium oxide by plasma spraying was placed in a microwave-excited high-density plasma chamber and plasma irradiation was performed at a partial pressure ratio of $NF_3$:Ar=1:1, at a sample temperature of 300° C., at a chamber pressure of 50 mTorr for 1 hour.

Figure 3:
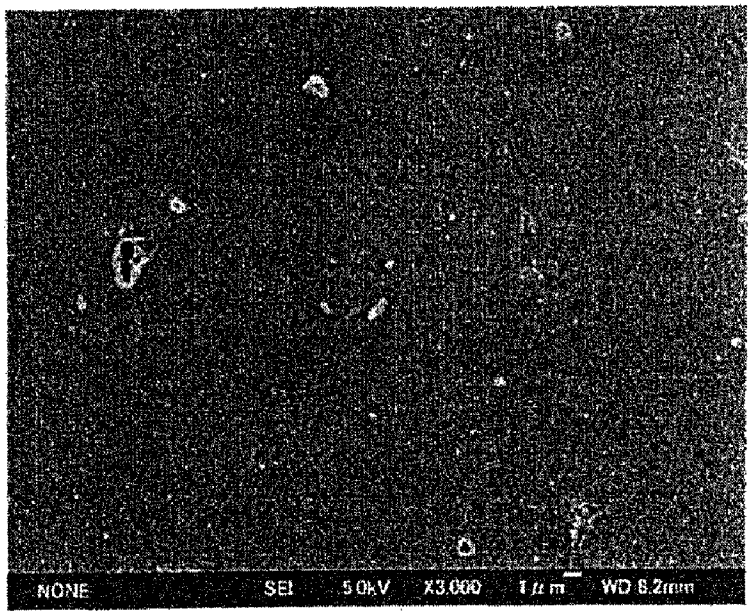
FIG. 3 shows a surface SEM observation image of protective film metal materials of this invention after $NF_3$ plasma irradiation.
Figure 3:
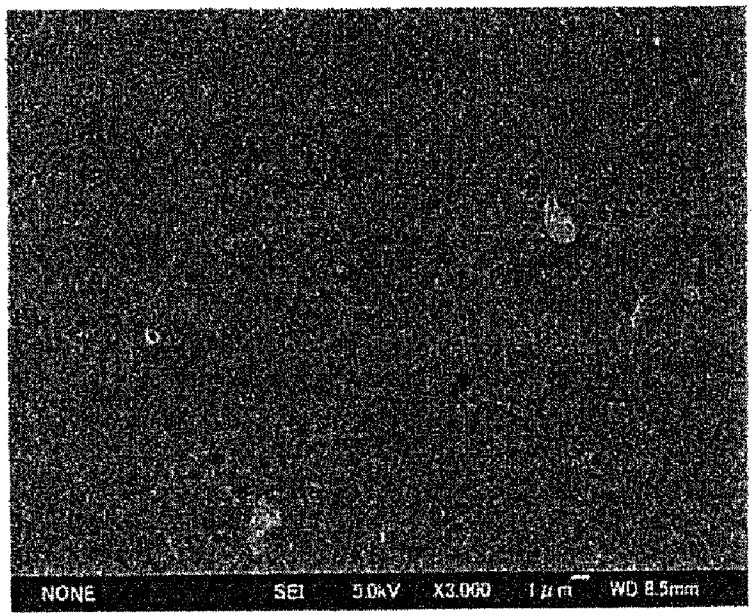

FIG. 3 shows SEM observation images of the sample surface before and after the plasma irradiation. It is seen that there is no change in the surface state and it is a very stable coating film.

When performing chamber cleaning after forming a film such as an amorphous silicon film, a silicon oxide film, or a silicon nitride film at 300° C., a mass-production apparatus is required to carry out the cleaning without lowering the temperature of a substrate stage. In the case of the conventional surface treatment such as the alumite, occurrence of metal contamination due to corrosion cannot be avoided without lowering the temperature at the time of the cleaning. In the case of the two-layer structure passive coating of this invention, it has been confirmed that such concern is small even at a portion where the temperature like that in the chamber of the microwave-excited high-density plasma apparatus is applied.

(Property Evaluation 2—Evaluation of Released Water Amount)

The amount of released water was measured with respect to a sample piece fabricated in the same manner as described above, i.e. applied with a first coating layer having a faultless aluminum oxide coating film with a thickness of 1μ or less formed as an underlayer by anodic oxidation using an organic anodization solution and a second coating layer formed of yttrium oxide by plasma spraying.

Figure 4:
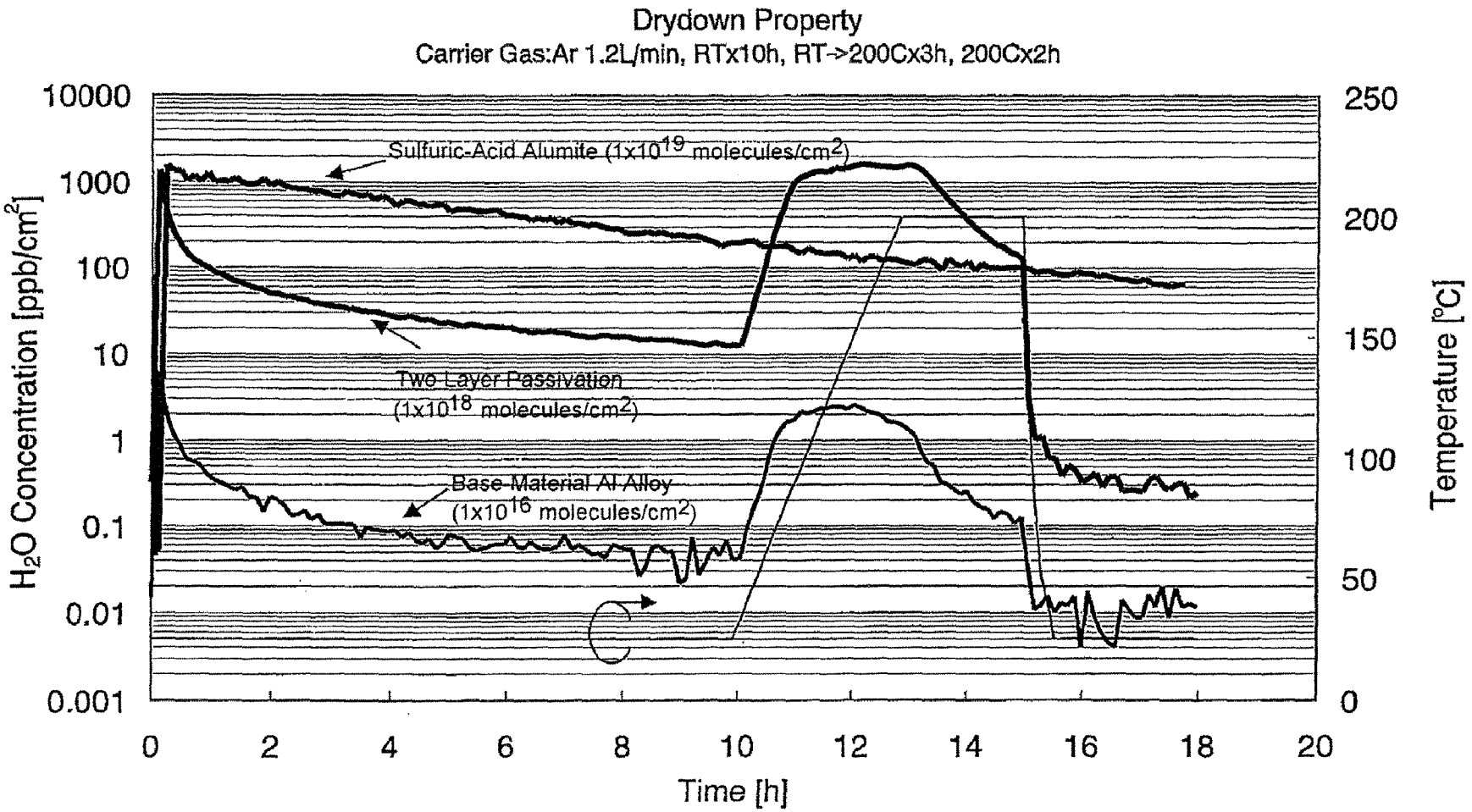
FIG. 4 shows the dry-down property of the protective film metal materials of this invention by APIMS measurement.

FIG. 4 shows data on the amount of released water measured by APIMS. As a comparative example, there is shown the amount of released water for a porous alumite sample obtained by anodic oxidation using a sulfuric acid anodization solution. The axis of abscissas represents the APIMS measurement time, the first axis of the axis of ordinates represents the amount of released water per unit area, and the second axis thereof represents the temperature profile in the measurement.

The temperature of the sample was maintained at room temperature for 10 hours, then was raised to 200° C. by 1° C./min and maintained for 2 hours, and then was lowered. Since the amount of released water from the porous alumite surface changed near the APIMS measurement upper limit at room temperature, the temperature of the sample was not raised. As a result of summing up the amounts of water released at room temperature, it is seen that the large amount of water as much as $1\times10^{19}$ molecules/$cm^2$ is generated from the alumite surface. In contrast, in the case of the two-layer structure plasma-sprayed sample of this invention, the amount of water released while the temperature of 200° C. was applied for 2 hours showed a one-digit lower value of $1\times10^{18}$ molecules/$cm^2$ and thus it is seen that this sample is more excellent in dry-down property. In a process under a reduced pressure, the magnitude of the released water amount in a chamber largely affects the process results. Further, the downtime increases due to outgas at the start after maintenance of the chamber, which adversely affects the productivity. Such problems cannot be avoided with the surface with the large amount of released water. This is still more in an apparatus for processing large-area substrates. In the case of the two-layer structure passive coating of this invention, it is possible to avoid such problems even at a place where the temperature like that in the chamber of the microwave-excited high-density plasma apparatus is applied.

(Property Evaluation 3—Evaluation of Crack after Heating)

Figure 5:
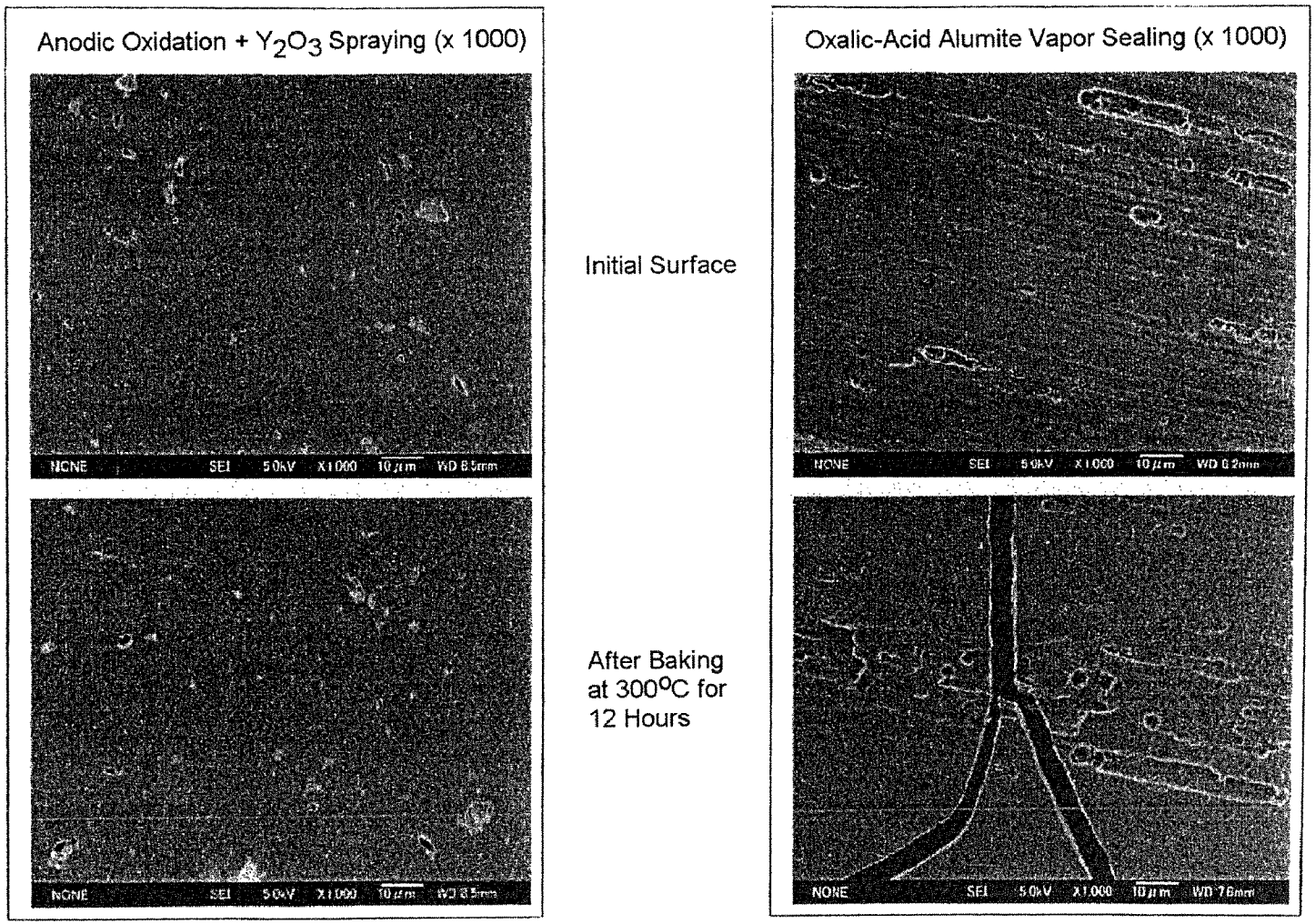
FIG. 5 shows a surface SEM observation image of the protective film metal materials of this invention after the application of a temperature of 300° C. for 12 hours.

The crack property upon the application of a temperature was evaluated with respect to a sample piece fabricated in the same manner, i.e. applied with a first coating layer having a faultless aluminum oxide coating film with a thickness of 1μ or less formed as an underlayer by anodic oxidation using an organic anodization solution and a second coating layer formed of yttrium oxide by plasma spraying. FIG. 5 shows data thereof. As a comparative example, the crack property of a sulfuric-acid alumite-treated sample was examined. There are also shown the surface states upon the application of 300° C.

It is seen that cracks occur in the sulfuric-acid alumite layer. In contrast, in the case of the two-layer passive coating of this invention, no signs such as cracks are observed at all in the sprayed film even upon the application of 300° C. In the sulfuric-acid alumite, invasion of a halogen gas and so on is allowed from such crack portions, thereby leading to a cause of corrosion. In the case of the two-layer structure passive coating of this invention, it has been confirmed that there is no such concern at all even at a place where the temperature like that in the chamber of the microwave-excited high-density plasma apparatus is applied.

(Property Evaluation 4—Evaluation of Adhesion by Chlorine Gas Exposure)

Evaluation of adhesion by chlorine gas exposure was performed with respect to a sample piece fabricated in the same manner, i.e. applied with a first coating layer having a faultless aluminum oxide coating film with a thickness of 1μ or less formed as an underlayer by anodic oxidation using an organic anodization solution and a second coating layer formed of yttrium oxide by plasma spraying. Table 1 shows data on evaluation of adhesion and crack property upon chlorine gas exposure.

TABLE 1

| Base Material: A6061 | | Adhesion Strength*/MPa | |
|---|---|---|---|
| Sprayed Film | Anodic Oxidation | Before Exposure | After Exposure |
| $Y_2O_3$ | Yes | 14 | 12 |
| | No | 14 | (Stripping) |
| $Al_2O_3$ | Yes | 14 | 10 |
| | No | 20 | (Stripping) |

*Pursuant to JIS H 8666

This adhesion evaluation is pursuant to JIS H8666. As a comparative example, the adhesion was examined by exposing to a chlorine gas a sample piece formed with coating layers of aluminum oxide and yttrium oxide on the surface of a solid Al alloy by plasma spraying. The conditions of the chlorine gas exposure were 100% $Cl_2$, 0.3 MPa sealing, and 100° C.×24 hours exposure.

Figure 6:
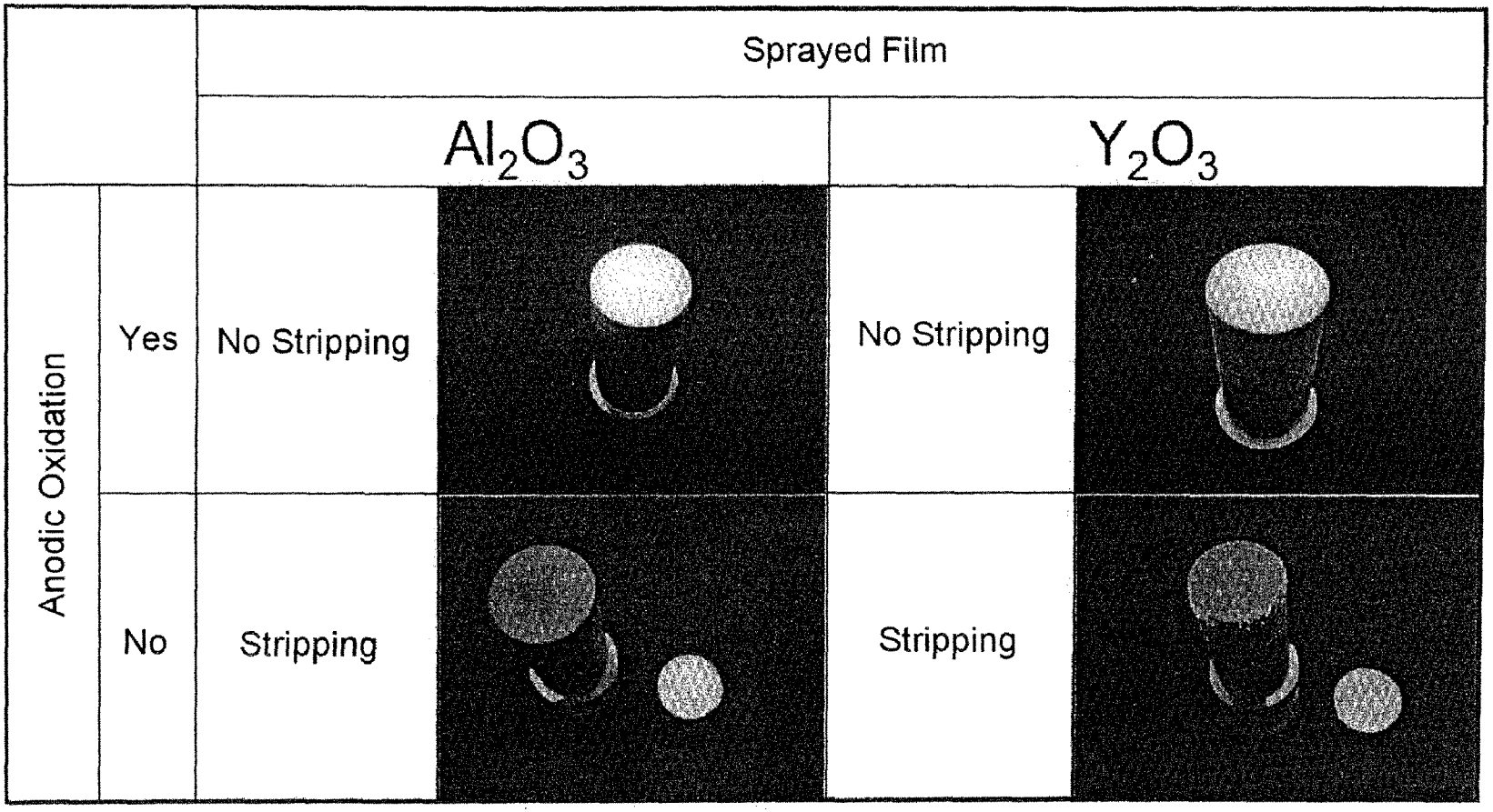
FIG. 6 shows the states of the protective film metal materials of this invention after chlorine gas exposure.

FIG. 6 shows the states of the plasma-sprayed films after the chlorine gas exposure.

It is seen that no stripping of the plasma-sprayed film is observed in the sample formed with the faultless anodized coating film as the underlayer, while, the plasma-sprayed films are stripped from the base material in the sample in which the plasma spraying is applied to the solid Al surface.

It is seen that the yttrium oxide film formed on the faultless anodized coating film and the aluminum oxide anodized film are each reduced in adhesion strength by about 10 to 20% relative to the initial adhesion strength, but the adhesion strengths with no problem for practical use are maintained. Such stripping of the plasma-sprayed films causes a serious problem such as a reduction in yield due to adhesion of dust to substrates. In the case of the two-layer structure passive coating of this invention, it has been confirmed that there is no such concern at all even at a place where the temperature like that in the chamber of the microwave-excited high-density plasma apparatus is applied.

Referring again to FIG. 2, a description will be given of the microwave plasma processing apparatus 10 to which the protective coating film structure of this invention is applied. The microwave plasma processing apparatus is made known by Japanese Unexamined Patent Application Publication (JP-A) No. 2002-299331, while, in this invention, the protective coating film structure of this invention is used in this processing apparatus.

Referring to FIG. 2(A), the microwave plasma processing apparatus 10 comprises a process container (process chamber) 11 and a holding stage 13 provided in the process container 11 for holding a processing substrate 12 using an electrostatic chuck and preferably formed of AlN or $Al_2O_3$ by a hot isostatic pressing (HIP) method. In the process container 11, exhaust ports 11*a* are formed at regular intervals, i.e. substantially axisymmetrically to the processing substrate 12 on the holding stage 13 at at least two positions, preferably at three or more positions in a space 11A surrounding the holding stage 13. The process container 11 is evacuated/reduced in pressure through the exhaust ports 11*a* by a variable pitch, variable inclination screw pump.

The process container 11 is preferably made of an Al alloy containing Al as a main component and its inner wall surface is formed with a faultless aluminum oxide coating film as a first coating layer by anodic oxidation using an electrolyte solution in the form of an organic anodization solution. Further, an yttrium oxide film is formed by a plasma spraying method as a second coating layer on the surface of the aluminum oxide coating film. At a portion, corresponding to the processing substrate 12, of the inner wall of the process container 11, a disk-shaped shower plate 14 formed of dense $Al_2O_3$ by the HIP method and formed with a number of nozzle openings 14A is formed as part of the inner wall.

On the shower plate 14, a cover plate 15 formed of dense $Al_2O_3$ by the same HIP process is provided through a seal ring. A plasma gas flow path 14B communicating with the respective nozzle openings 14A is formed on the side, contacting the cover plate 15, of the shower plate 14. The plasma gas flow path 14B communicates with another plasma gas flow path 14C formed inside the shower plate 14 and communicating with a plasma gas inlet 11*p* formed in the outer wall of the process container 11.

The shower plate 14 is held by a bulged portion 11*b* formed at the inner wall of the process container 11. A portion, holding the shower plate 14, of the bulged portion 11*b* is rounded for suppressing abnormal discharge.

A plasma gas such as Ar or Kr supplied to the plasma gas inlet 11*p* passes through the flow paths 14C and 14B inside the shower plate 14 in order, then is uniformly supplied into a space 11B just under the shower plate 14 through the openings 14A.

On the cover plate 15, there is provided a radial line slot antenna 20 comprising a disk-shaped slot plate 16 placed in tight contact with the cover plate 15 and formed with a number of slots 16*a* and 16*b* as shown in FIG. 2(B), a disk-shaped antenna body 17 holding the slot plate 16, and a phase delay plate 18 made of a low-loss dielectric material such as $Al_2O_3$, $SiO_2$, or $Si_3N_4$ and interposed between the slot plate 16 and the antenna body 17. The radial line slot antenna 20 is mounted on the process container 11 through a seal ring 11*u*. A microwave having a frequency of 2.45 GHz or 8.3 GHz is supplied to the radial line slot antenna 20 from an external microwave source (not shown) through a coaxial waveguide 21. The supplied microwave is radiated into the process container 11 from the slots 16*a* and 16*b* of the slot plate 16 through the cover plate 15 and the shower plate 14 and excites a plasma in the plasma gas supplied from the openings 14A in the space 11B just under the shower plate 14. In this event, the cover plate 15 and the shower plate 14 are formed of $Al_2O_3$ and thus serve as efficient microwave transmitting windows.

Of the coaxial waveguide 21A, an outer waveguide 21A is connected to the disk-shaped antenna body 17, while, a center conductor 21B is connected to the slot plate 16 through an opening formed in the phase delay plate 18. Accordingly, the microwave supplied to the coaxial waveguide 21A is radiated from the slots 16*a* and 16*b* while advancing radially between the antenna body 17 and the slot plate 16.

Referring to FIG. 2(B), the slots 16*a* are arranged concentrically and the slots 16*b* perpendicular to the slots 16*a* are also arranged concentrically so as to correspond to the slots 16*a*, respectively. The slots 16*a* and 16*b* are arranged in the radial directions of the slot plate 16 at an interval corresponding to the wavelength of the microwave compressed by the phase delay plate 18 and, as a result, the microwave is radiated from the slot plate 16 in the form of a substantially plane wave. In this event, since the slots 16*a* and 16*b* are arranged perpendicular to each other, the microwave thus radiated forms a circularly polarized wave including two orthogonal polarized wave components.

Further, in the microwave plasma processing apparatus 10 of FIG. 2(A), between the shower plate 14 and the processing substrate 12 on the holding stage 13 in the process container 11, there is provided a lower shower plate (process gas supply structure) 31 having a lattice-shaped process gas path 31A supplied with a process gas from a process gas inlet 11*r* provided in the outer wall of the process container 11 and ejecting it from a number of process gas nozzle openings 31B (see FIG. 7), so that desired uniform substrate processing is carried out in a space 11C between the process gas supply structure 31 and the processing substrate 12. Such substrate processing includes plasma oxidation processing, plasma nitriding processing, plasma oxynitriding processing, plasma CVD processing, or the like. Further, it is possible to perform reactive ion etching for the processing substrate 12 by supplying a fluorocarbon gas such as $C_4F_8$, $C_5F_8$, or $C_4F_6$ liable to dissociate or an F-based or Cl-based etching gas into the space 11C from the process gas supply structure 31 and applying a high-frequency voltage to the holding stage 13 from a high-frequency power supply 13A.

Figure 7:
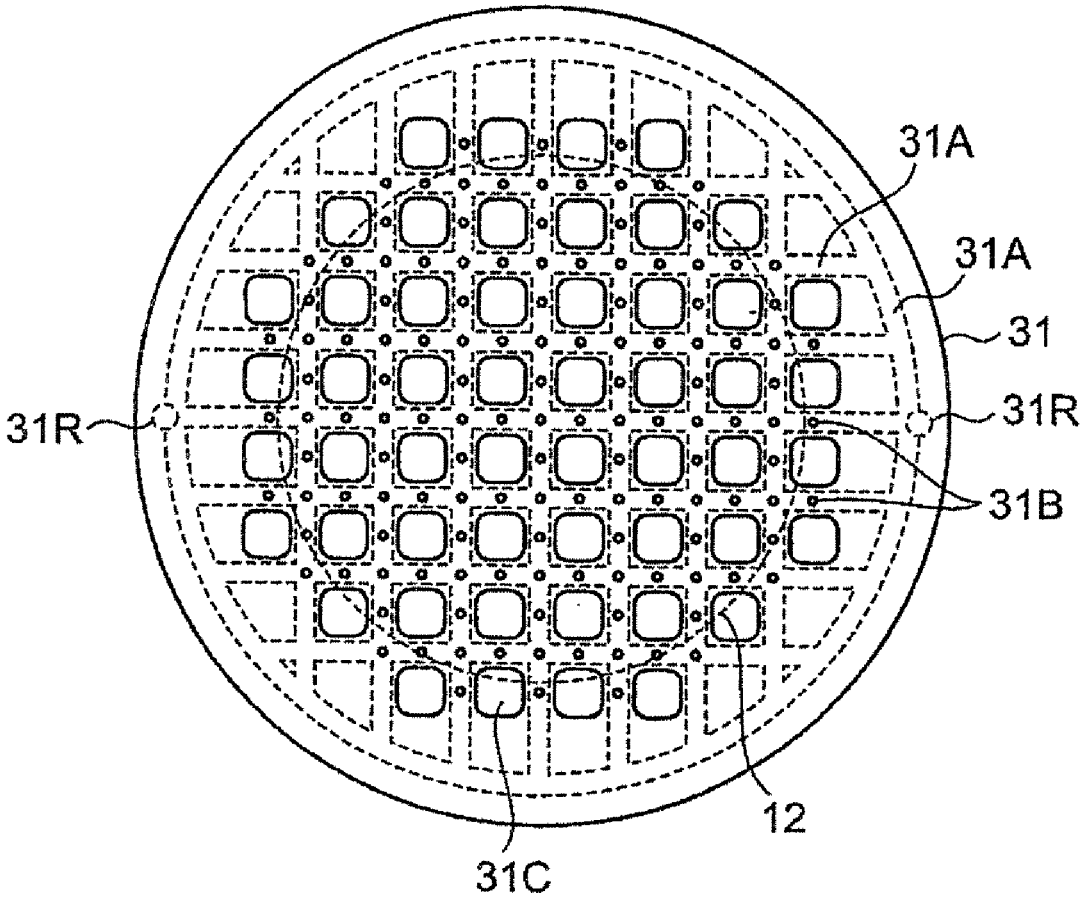
FIG. 7 is a plan view of a lower shower plate of the semiconductor manufacturing apparatus shown in FIG. 2.

Referring to FIG. 7, the lower shower plate (process gas supply structure) 31 is such that, like the inner wall of the process container, an aluminum oxide protective film is formed by anodic oxidation as a first coating layer on an alloy base material containing Al as a main component and an yttrium oxide film is formed as a second coating layer on the first coating layer in the same manner as described above. The lattice-shaped process gas path 31A is connected to the process gas inlet 11*r* at its process gas supply ports 31R and uniformly ejects the process gas into the space 11C from the number of process gas nozzle openings 31B formed at the bottom surface. Further, the process gas supply structure 31 is formed with openings 31C between adjacent portions of the process gas path 31A for allowing the plasma and the process gas contained in the plasma to pass therethrough.

The lattice-shaped process gas path 31A and the process gas nozzle openings 31B are provided so as to cover a region slightly larger than the processing substrate 12 indicated by a broken line in FIG. 3. By providing such a lower shower plate (process gas supply structure) 31 between the upper shower plate 14 and the processing substrate 12, it becomes possible to plasma-excite the process gas and carry out uniform processing with such a plasma-excited process gas.

In this processing apparatus, the inner wall of the processing apparatus and the component in the processing apparatus such as, for example, the lower shower plate, are each formed with the aluminum oxide first coating film formed by direct oxidation of the Al alloy base material containing Al as the main component and the yttrium oxide second coating film formed on the first coating film and, therefore, it is possible to prevent metal contamination of the surface of the substrate from the inside of the substrate processing chamber.

Further, by applying the foregoing protective coating film structure to piping and so on in the processing apparatus, it is possible to suppress stoppage of the apparatus/a reduction in operation rate of the apparatus caused by corrosion of an exhaust pump, exhaust system piping, or an exhaust valve. Further, it is possible to suppress deposition of reaction products, caused by dissociation of a process gas, in the semiconductor or flat panel display manufacturing apparatus and further to suppress deposition of reaction by-products on the inner surface by maintaining the manufacturing apparatus in a heated state at a temperature higher than room temperature. There is obtained a multifunction manufacturing apparatus that is capable of carrying out several kinds of processes in a single substrate processing chamber to thereby realize a staged investment type semiconductor or flat panel display production system.

The invention claimed is:

1. A protective film structure of a metal member for use in an apparatus for manufacturing a semiconductor or the like, said protective film structure comprising:

a first coating layer of faultless aluminum oxide formed by direct anodic oxidation of a base-material metal of an aluminum alloy; and a second coating layer formed on the first coating layer and made of yttrium oxide by a plasma spraying method.

2. A protective film structure of a metal member according to claim 1, wherein a surface of said base-material metal is blasted before forming said first coating layer.

3. A protective film structure of a metal member according to claim 1, wherein said first coating layer is formed by anodic oxidation using an electrolyte solution in the form of an organic anodization solution of pH 4 to pH 10.

4. A protective film structure of a metal member according to claim 1, wherein said first coating layer is formed by anodic oxidation using an electrolyte solution in the form of an inorganic anodization solution of pH 4 to pH 10.

5. A protective film structure of a metal member according to any one of claims 1, 2, 3, or 4, wherein said first coating layer has a thickness of 10 nm or more and 1 micrometer or less.

6. A protective film structure of a metal member according to claim 1, wherein said second coating layer of yttrium oxide is about 200 micrometers.

7. A gas supply shower head for a semiconductor or flat panel display manufacturing apparatus, using the protective film structure of the metal member according to claim 1.

8. A metal component for a semiconductor or flat panel display manufacturing apparatus, using the protective film structure of the metal member according to claim 1.

9. A semiconductor or flat panel display manufacturing apparatus using the protective film structure of the metal member according to claim 1.

10. A semiconductor or flat panel display manufacturing apparatus using the protective film structure of the metal member according to claim 1 for an inner wall of a process chamber.

* * * * *